US005268040A

United States Patent [19]

Naito et al.

[11] Patent Number: 5,268,040

[45] Date of Patent: Dec. 7, 1993

[54] METHOD FOR STEEL SURFACE HARDENING TREATMENT AND AN APPARATUS THEREFOR

[75] Inventors: Takeshi Naito; Masahiro Azumi, both of Yokohama, Japan

[73] Assignee: Dowa Mining Co., Ltd., Tokyo, Japan

[21] Appl. No.: 955,929

[22] Filed: Oct. 2, 1992

[30] Foreign Application Priority Data

Oct. 8, 1991 [JP] Japan ..... 3-289160

[51] Int. Cl.[5] ..... C21D 1/18

[52] U.S. Cl. ..... 148/233; 266/252; 266/254; 148/226

[58] Field of Search ..... 148/233; 266/252, 251, 266/254

[56] References Cited

U.S. PATENT DOCUMENTS 5,019,182 5/1991 Arimi et al. ..... 148/219

FOREIGN PATENT DOCUMENTS 737479 5/1980 U.S.S.R. ..... 148/233

*Primary Examiner*—Deborah Yee

*Attorney, Agent, or Firm*—Bauer & Schaffer

[57] ABSTRACT

A method of cooling steel parts from austenitic stage to a temperature that is higher than its Ms point after carburization of said steel part to carry out diffusion transformation, then carrying out a nitriding treatment and further applying shot peening, and in order to implement said method provide a carburizing zone, a cooling zone for carrying out diffusion transformation and a nitriding treatment zone connected through opening and shutting doors, and provide feeding devices in each of said zones to feed the steel parts to the next zone.

4 Claims, 12 Drawing Sheets

METHOD FOR STEEL SURFACE HARDENING TREATMENT AND AN APPARATUS THEREFOR

FIELD OF THE INVENTION

This invention relates to a method for steel surface hardening treatment and an apparatus which can be used to implement a steel surface hardening treatment, in order to improve wear resistance properties by the surface hardening treatment of steel parts, to achieve a highly accurate measurement of steel parts by preventing the distortion of said steel parts at the time of surface hardening treatment and further to attempt improvement in fatigue strength associating with gain of a compressive residual stress.

BACKGROUND OF THE INVENTION

Heretofore, a carburized hardening or an induction hardening is employed for a surface hardening treatment of steel. Both of these methods were of obtaining a hard martensitic structural component by heating steel up to the austenitic stage and followed by quick cooling of that steel, i.e. quenching ( see "Heat Treatment of Steel"]5th edition, pp. 253–266, 1985; Maruzen). As an apparatus therefor, so-called batch-type furnace, continuous furnace and the like have been provided.

The aforementioned surface hardening treatment methods of steel using the conventional hardening are being widely employed for production of various industrial products, however there were many problems in these methods because they utilize the martensitic structural components. In some cases, a satisfactory result can not be obtained by these methods in view of the surfacial hardness, that is, the mechanical properties such as the wear and abrasion resistance, pitching resistance and the like. In addition to that, a distortion of measurement in the steel part occurs by the hardening.

BRIEF SUMMARY OF THE INVENTION

The present invention was made in consideration of the aforementioned circumstances so, without adopting a hardening process to obtain the martensitic structural components as in the past, the object is to provide a surface hardening treatment method that improves the hardness of the steel surface and prevents changes in measurement after treatment of the steel parts and an apparatus to implement the method therefor.

The invention of the surface hardening treatment method under the present invention carries out, after subjecting steel parts to a carburizing treatment, a diffusion transformation by cooling to a temperature that is higher than its Ms point from the austenitic stage and next carrying out a nitriding, then further performing a shot peening. The invention of the surface hardening treatment apparatus has provided therein a carburizing zone and a cooling zone to carry out diffusion transformation connected through an opening and shutting door to a nitriding zone to carry out the formation of a nitride layer, and each of said zones is provided with a feeding apparatus to transport the treating steel parts to the next zone. Further, a heat exchange device is provided in said cooling zone.

DETAILED DESCRIPTION OF THE INVENTION

The present invention is to penetrate carbon and nitrogen into steel and further applies shot peening on its surface. However, it is not possible to obtain the same degree of hardness by only penetrating the steel with carbon and nitrogen as that obtainable by a conventional hardening. Thus, the present invention first carries out carburization to a required hardness depth by the carburizing treatment, and next carries out diffusion transformation by cooling to a temperature that is higher than the Ms point, at which the structure changes from the austenite to the martensite, to effect a change to a structure consisting with mainly bainite and some pearlite and a little troostite. Next it is subjected to a nitriding to implement a solid-solution hardening or a formation of nitrides by nitrogen atoms and obtaining the required hardness. Further, by applying shot peening to the surface a compressive residual stress is given to the material, and a surface layer with a higher hardness is obtained.

Furthermore, by not adopting the conventional hardening treatment, the treated item has been prevented from creating changes in its measurements after treating. That is, in order to prevent the physical formation of a martensite structure formed through conventional hardening and accompanying distortion of the treated steel parts after treating, diffusion transformation was implemented after the carburizing treatment in an entirely different concept from past methods to obtain a structure consisting mainly of bainite, some pearlite and a little troostite which was then subjected to a nitriding treatment. Of course, the treated steel parts can also be cooled to room temperature after the aforementioned carburizing and diffusion transformation, then subsequently subjected to a nitriding.

Figure 1:
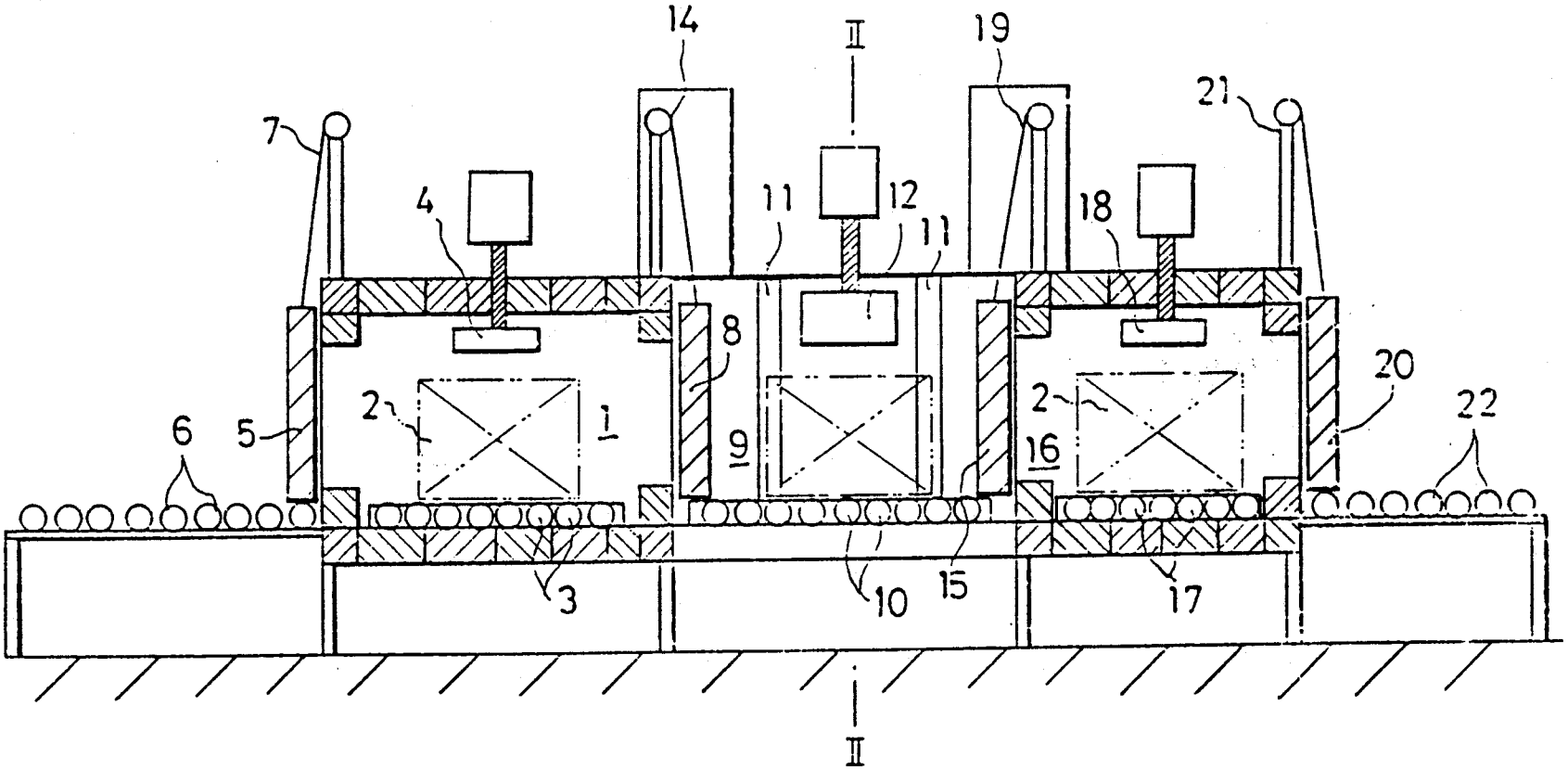
FIG. 1 is a vertical section view of the treatment apparatus under the present invention.
Figure 2:
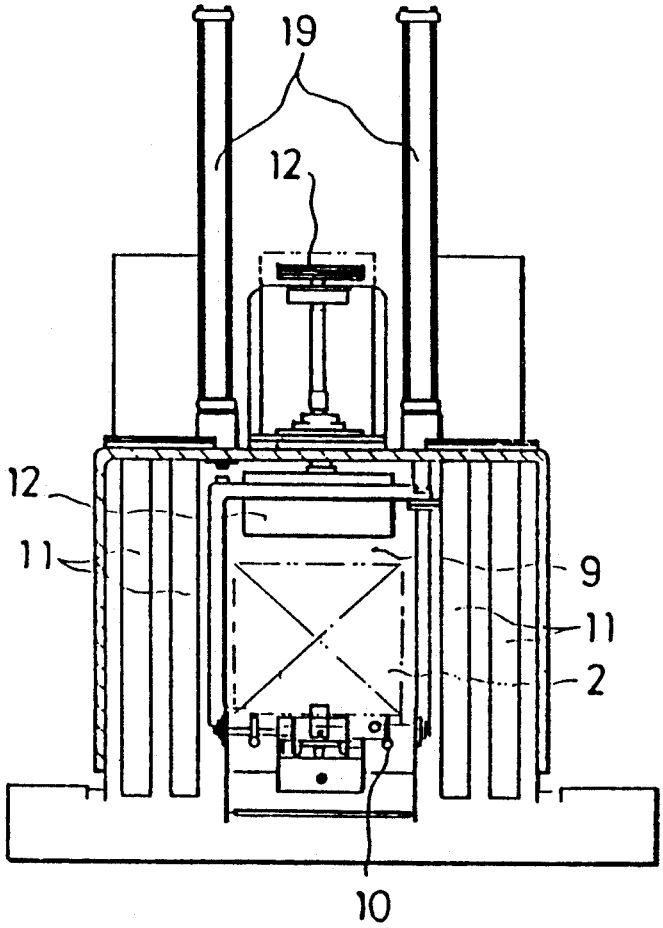
FIG. 2 is a cross sectional view of line II—II in FIG. 1.
Figure 3:
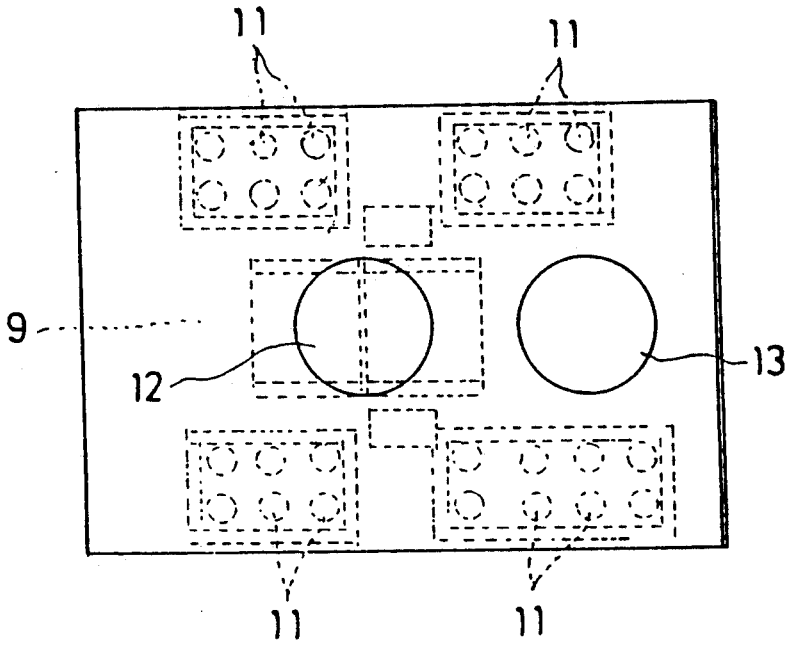
FIG. 3 is a plane drawing of the cooling zone compartment.

First, the apparatus under the present invention will be explained below. In the drawing (FIG. 1), 1 is a carburizing zone and a feed roller 3 for steel parts 2 is provided on the floor section and, although not shown in detail, heaters are provided on both sides of said feed roller 3. Further, an agitating fan is provided on the furnace ceiling. In the drawing, 5 is an inlet door, 6 is a take-in roller for steel parts 2, 7 is an opening and shutting device for the inlet door 5 for which an air cylinder or chain hoist system is generally adopted.

Next, in said carburizing zone 1 there is provided adjacently a cooling zone 9 through an opening and shutting door 8 in which diffusion transformation is carried out. Said cooling zone 9 has provided on its floor section a feed roller 10 for the steel parts 2 which is interlocked to the feed roller 3 installed on the floor section of the said carburizing zone 1 with heat exchanger 11 provided on both sides of the feed roller 10 and an agitator fan provided on the ceiling. Said heat exchanger 11 is, for example, constructed as a cylinder with its base part closed and, although not shown in the drawing, it is filled with water and moreover a heater to heat the said water is enclosed therein. Of course, instead of said heaters, said water can be heated by burning the exhaust gas from the carburizing compartment 1. In the drawing, 13 is an explosion-proof valve and 14 is a opening and shutting device of the opening and shutting door 8.

Furthermore, a nitriding zone 16 is adjacently provided to said cooling zone 9 through an opening and shutting door 15. Said nitriding compartment 16 is virtually identical in construction with said carburizing zone 1 and has installed on its floor section a feed roller 17 for the steel parts 2 which is interlocked to the feed roller 10 for the steel parts 2 installed on the floor section of said cooling zone and, not shown in detail, heaters are provided on both sides of said feed rollers 17. Furthermore, an agitator fan 18 is installed on the furnace ceiling. In the drawing, 19 is an opening and shutting device, 20 an exit door, 21 an opening and shutting device for said exit door, and 22 is a take-out roller.

According to the present invention, the steel parts 2 are brought into the carburizing zone 1 through the inlet door 5 and subjected to carburization of a required carburizing depth by adjusting the treatment temperature and treatment time. Next, the opening and shutting door 8 is opened and the steel parts 2 are fed by the feed roller 3 and the feed roller 10 to the temperature cooling zone 9 in which diffusion transformation is carried out. Said cooling zone 9 is filled with carburizing gas, nitrogen gas, etc, that were used in the carburizing zone 1 and the steel parts 2 are cooled to a temperature that is higher than the Ms point of said steel part 2 by the heat exchange and agitator fan 12 which are provided inside of said cooling zone 9.

That is, if the steel parts 2 are cooled to below the Ms point they are transformed into martensite which is no different than conventional hardening. However, in the present invention they are cooled to a temperature that is higher than the Ms point as described above and the austenite formed by said carburizing treatment is subjected to diffusion transformation to obtain a structure consisting with mainly bainite and some pearlite and a little troostite. Then subsequently the opening and shutting door 15 is opened and the steel parts are fed into the nitriding zone 16 by the feed roller 10 and the feed roller 17.

Nitriding treatment is carried out with ammonia gas alone, a mixture of ammonia gas and RX gas, a mixture of ammonia gas and nitrogen gas, and the like. After completion of the aforementioned treatment, the outlet door 20 is opened and the steel parts 2 are taken out into the atmosphere. Furthermore, in order to improve coloration or productivity due to oxidation of the surface, a suitable cooling compartment can also be installed at the outlet door 20 for quick cooling.

The surface can be hardened with the treatments described above without hardening as the conventional method. However, in order to further improve the surface hardness and to provide compressive residual stress thereto, the mechanical properties of the steel part surface can be improved by subsequent shot peening treatments.

With the aforementioned surface hardening treatment apparatus under the present invention, the surface hardening treatment operation can be continuously implemented.

A concrete example for the surface hardening treatment process using and operating said apparatus under the present invention is described below.

The chemical compositions of the 4 kinds of steel test pieces (A, B, C, D) used in the experiment are as shown below.

| | Chemical Composition of the Materials (wt %) | | | | | | | |
|---|---|---|---|---|---|---|---|---|
| | C | Si | Mn | Ni | Cr | Mo | V | W |
| A | 0.21 | 0.98 | 0.58 | 0.06 | 1.53 | 1.00 | Tr | — |
| B | 0.22 | 0.38 | 0.49 | 0.06 | 0.99 | 4.77 | 0.89 | — |
| C | 0.15 | 0.39 | 0.49 | 3.02 | 0.98 | 4.55 | 0.31 | — |
| D | 0.15 | 1.02 | 0.32 | 0.09 | 5.07 | 1.53 | 0.51 | 1.58 |

First, said test pieces A, B, C and D were put into the carburizing zone 1 and subjected to carburization. In said carburization, Rx gas was used and the treatment was conducted at 930° C. for 4.5 hours. Moreover, this carburizing treatment is not limited to the method of using RX gas, but the direct carburizing methods, for example Japanese Patent Application Laid Open No. 45359/1988, the drip feed carburizing method, or nitrogen base carburizing method, would also be all right. Next, the materials were cooled to 840° C. in the carburizing zone, then the test pieces were transferred to the cooling zone 9 in where the material temperature was cooled to 480° C. which is higher than Ms points for said test pieces A, B, C and D, and maintained at 480° C. for 5 hours. Then, the test pieces were transferred to the nitriding zone 16 in where they were subjected to nitriding at 525° C. for 12 hours. Further, a nozzle type shot peening was applied. The conditions for the shot peening were: air pressure at 6 kg/square centimeter, exposure time 90 seconds, shot flow rate 20 kg/minute, the steel balls used were 0.6 mm in diameter.

Figure 4:
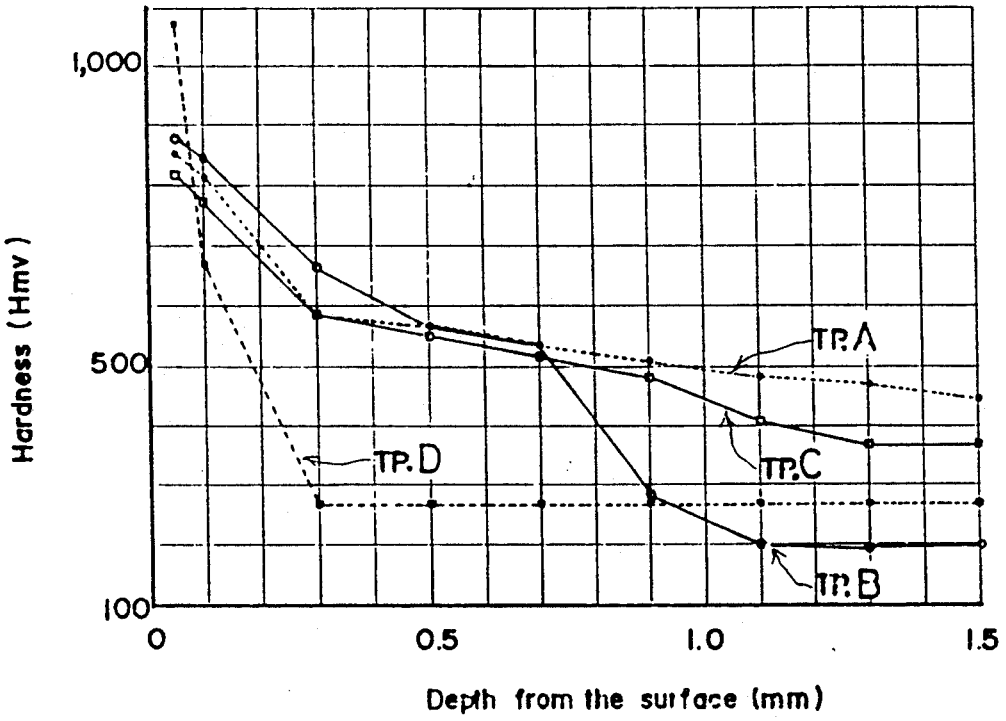
FIG. 4 is a chart showing the cross sectional hardness measured for 4 kinds of test pieces according to the method under the present invention.

The hardness distribution of cross section of each test piece prior to the aforementioned shot peening treatment are shown in FIG. 4. That is, surface hardness has reached HV810–1060 and case depth 0.6–0.7 mm, and it was confirmed that they are equal to the product made by the conventional method which will be described later (FIG. 13).

Figure 5:
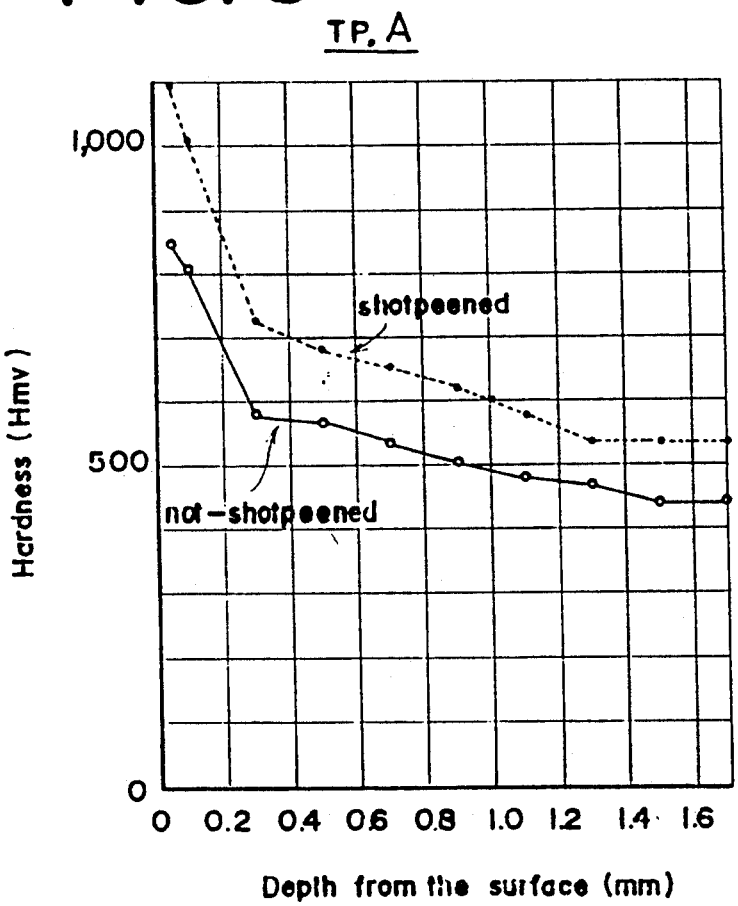
FIG. 5 is a chart showing the cross sectional hardness measured for test piece A according to the method under the present invention.
Figure 6:
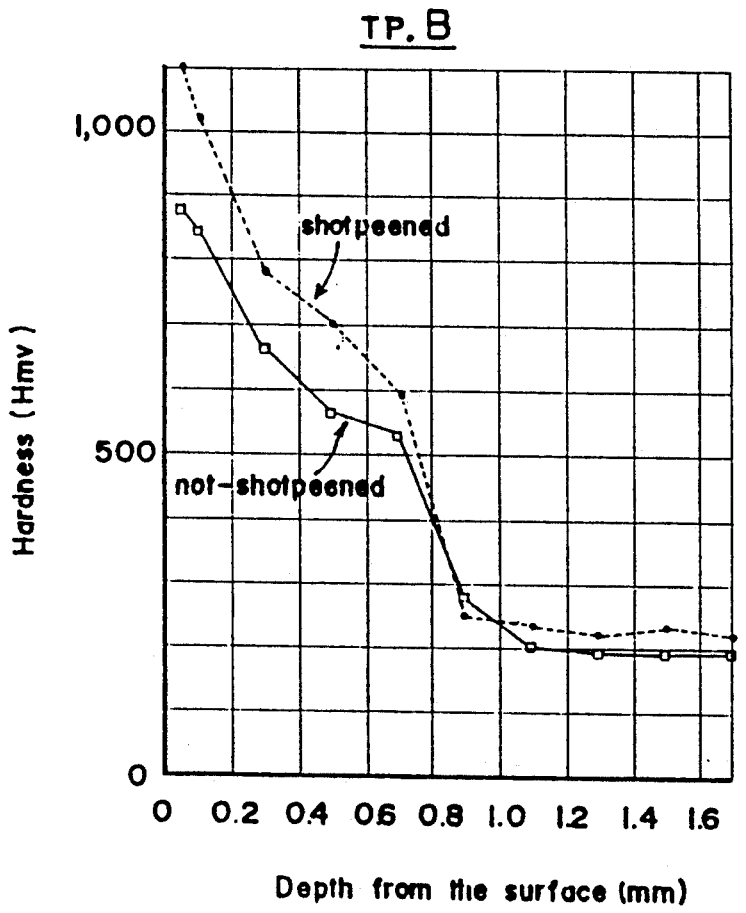
FIG. 6 is a chart showing the cross sectional hardness measured for test piece B according to the method under the present invention.
Figure 7:
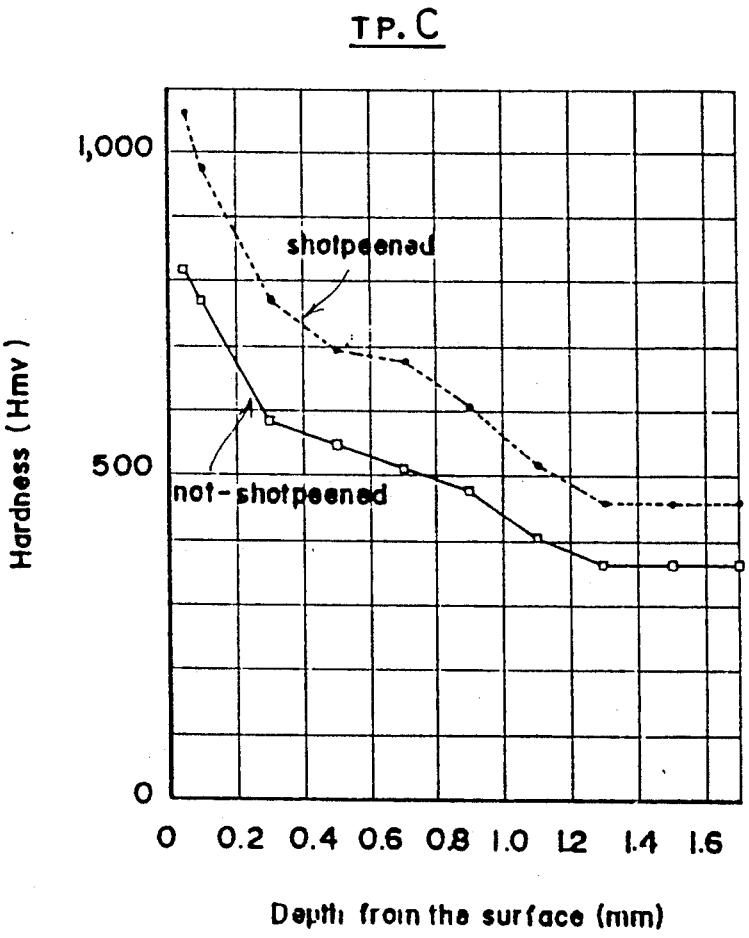
FIG. 7 is a chart showing the cross sectional hardness measured for test piece C according to the method under the present invention.
Figure 8:
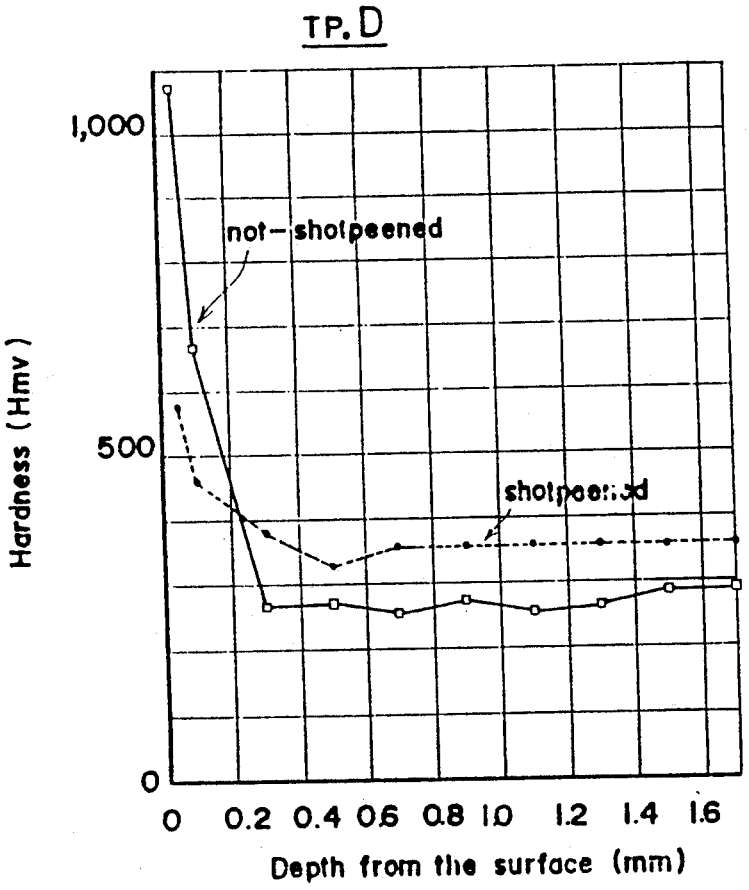
FIG. 8 is a chart showing the cross sectional hardness measured for test piece D according to the method under the present invention.

The hardness distribution of cross section of test pieces A, B, C, and D subsequently treated with shot peening were compared to the measurement results of aforementioned FIG. 4, and are shown in FIG. 5–FIG. 8. That is, FIG. 5 represents the test piece A, FIG. 6 the test piece B, FIG. 7 the test piece C, and FIG. 8 the test piece D. That is, in test piece D the hardness of the top surface dropped because the surface peeled off with the shot peening, but the surface hardness of the others reached to HV1050-1100 and the case depth to 0.7-1.1 mm and a high hardness value which are comparable to the values obtainable with conventional quenching methods as described later.

Figure 9:
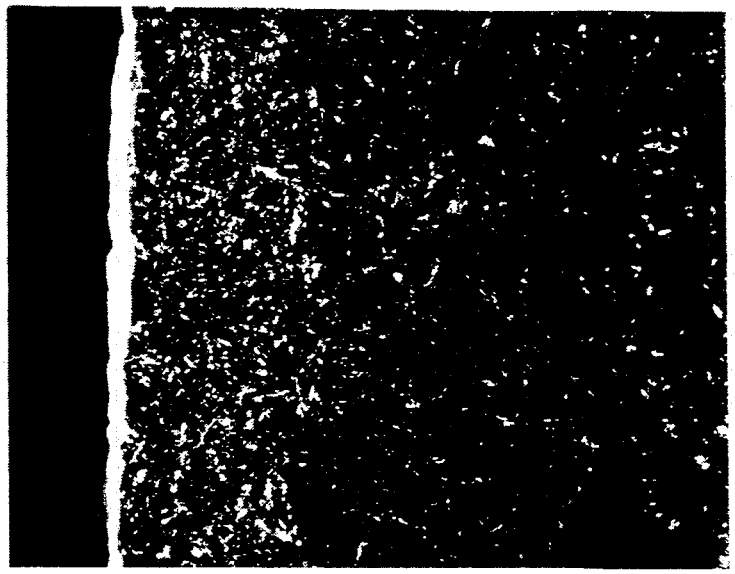
FIG. 9 is a microscopic photograph (×400) showing the cross sectional structure of test piece A.
Figure 10:
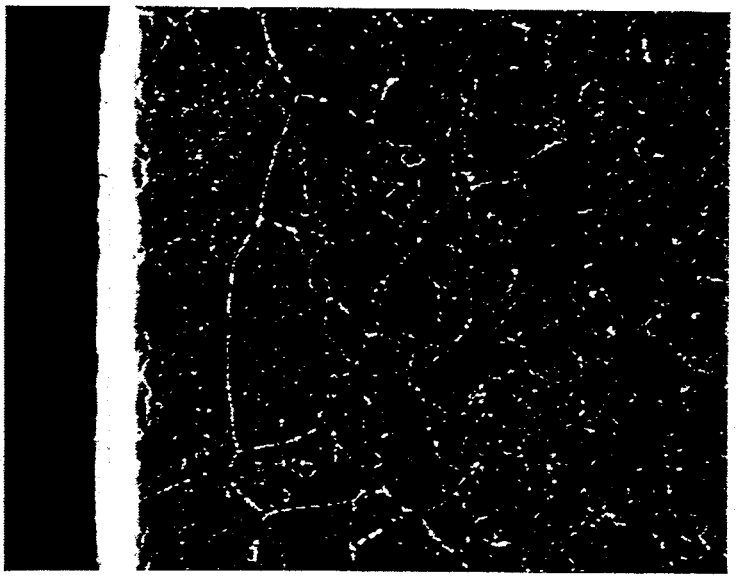
FIG. 10 is a microscopic photograph (×400) showing the cross sectional structure of test piece B.
Figure 11:
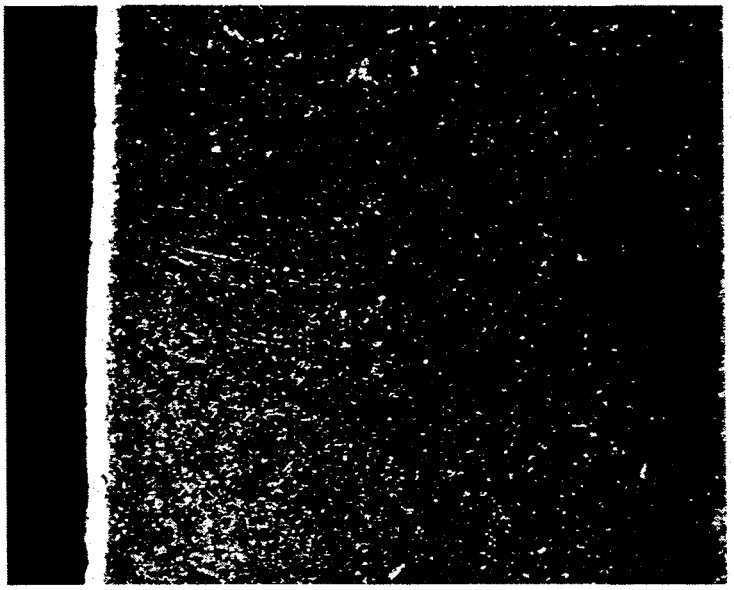
FIG. 11 is a microscopic photograph (×400) showing the cross sectional structure of test piece C.
Figure 12:
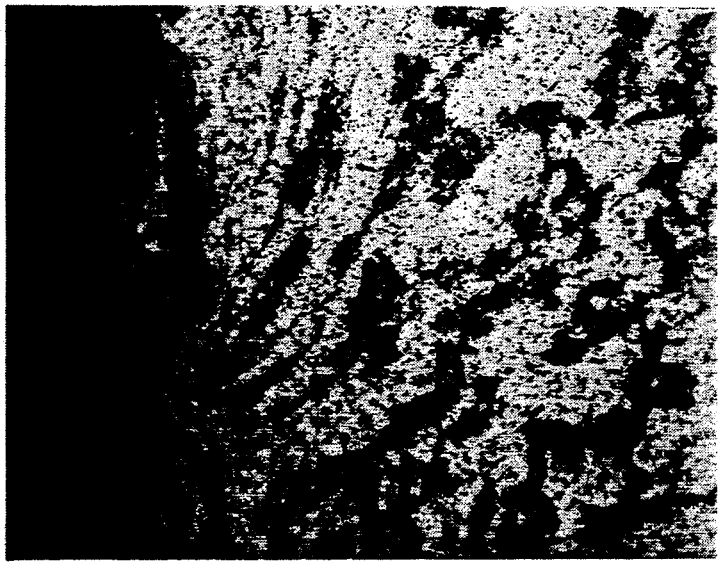
FIG. 12 is a microscopic photograph (×400) showing the cross sectional structure of test piece D.

Furthermore, FIG. 9-FIG. 12 are microscopic photographs (×400) showing the post treatment compositions of said test pieces A, B, C and D. FIG. 9 represents the test piece A, FIG. 10 the test piece B, FIG. 11 the test piece C and FIG. 12 the test piece D, and as described above in test piece D the top surface layer had peeled off.

Figure 13:
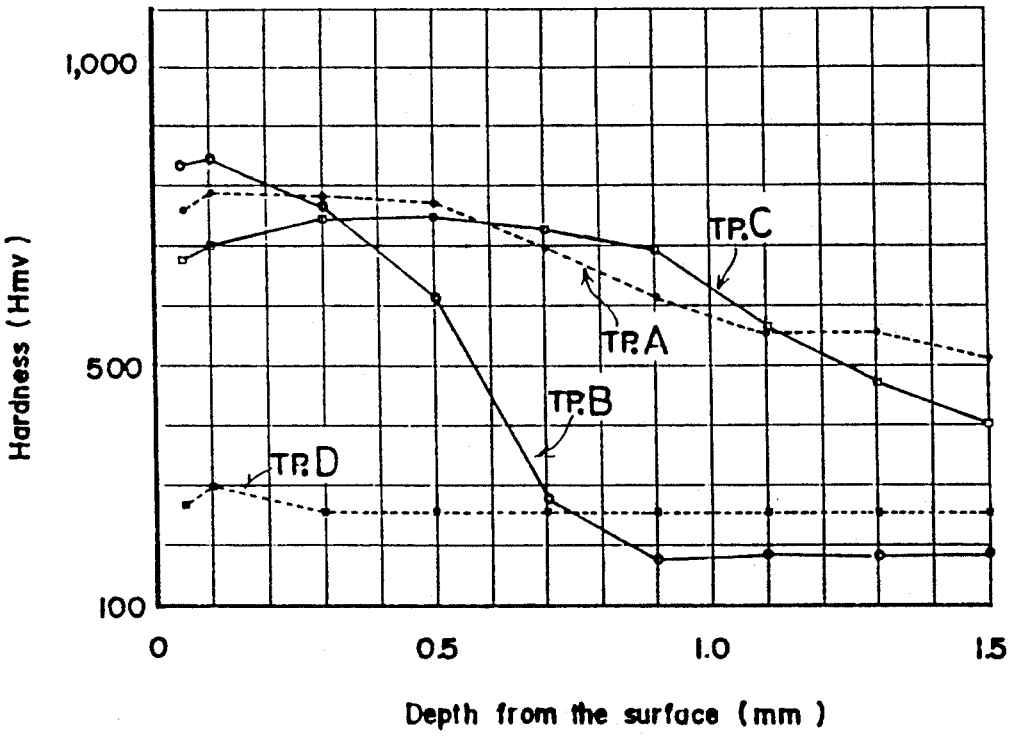
FIG. 13 is a chart showing the cross sectional hardness measured for test pieces of 4 kinds according to a conventional carburizing method.

Also, FIG. 13 is the hardness distribution of cross section of test pieces A, B, C and D according to a conventional carburizing method, and is the result of carrying out hardening after a carburizing treatment under the aforementioned carburizing conditions and further implementing a tempering at 160° C. for 2 hours. Excluding test piece D, the surface hardness was HV 680-820 and case depth 0.55-1.1 mm.

Chart 2 below shows comparison of the measurement results for the test pieces made by the conventional carburizing method and for the test pieces made by the method under the present invention.

| | Profile form deviation | Pitch error | Helix form deviation |
|---|---|---|---|
| Conventional carburizing | 13-18 μm | 13-18 μm | 12-15 μm |
| Present invention | 4-6 μm | 4-6 μm | 6-8 μm |

Figure 14:
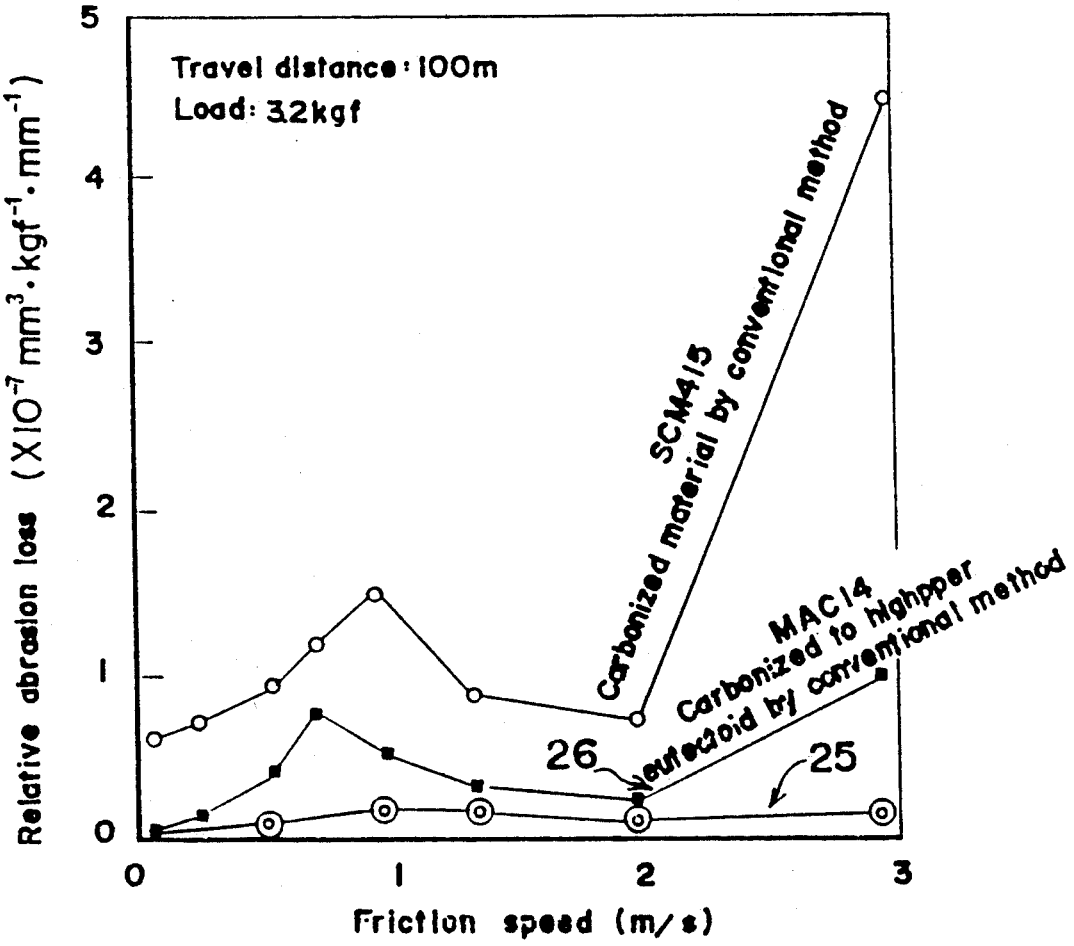
FIG. 14 is a chart showing abrasion test results.

The chemical composition of the spur gear for the steel part used here is identical with said test piece C and its form is: module 2.5 mm, pitch circle diameter 70 mm, teeth number 28, and tooth width 20 mm. As is evident from the aforementioned chart 2, it has been confirmed that the amount of distortion by the method of the present invention has been reduced to ⅓ compared to the conventional treatment method. Consequently, it is possible to attain such effect as making unnecessary the mechanical grinding process that is implemented in conventional method in order to correct the distortion occurring after treatments. FIG. 14 shows the results of wear tests (Ohgoshi's method). In the figure, the curve 25 represents the treatment by the method under the present invention (however, excluding said test piece D), and it was observed that its wear abrasion resistance properties is superior over a hypereutectoid carburized material which is shown by the curve 26 and recognized to be most superior in wear resistance properties among the conventional carburization.

Also, in test results of rotating bending fatigue test, the fatigue limit for said conventional carburization was 153 kg/square millimeter in the case where the best results were obtained by varying the shot peening conditions, while the fatigue limit for the treatment by the method under the present invention (excluding said test piece D) was 163 kg/square millimeter which exceeded that of said conventional method and thereby confirmed its superior results.

According to the present invention, improvement in wear resistance properties can be anticipated because a higher surface hardness can be obtained compared to the steel surface hardening treatment methods provided heretofore. While also the amount of distortion of the treated steel parts measurements will be minimized because there is no need for hardening, and moreover such operations as cleaning up of quenching oil will become unnecessary and industrial efficacy will be great. Furthermore, a compressive residual stress will be given by shot peening and improvement in fatigue strength can be anticipated. Also, according to the apparatus under the present invention, the aforementioned method can be efficiently implemented continuously.

What is claimed is:

1. A steel surface hardening treatment method comprising the steps of cooling steel parts from austenitic stage to a temperature that is higher than its Ms point after carburization of said steel part to carry out diffusion transformation, then carrying out a nitriding treatment.

2. A steel surface hardening treatment method comprising the steps of cooling a steel part from austenitic stage to a temperature that is higher than its Ms point after carburization of said steel part to carry out diffusion transformation, then carrying out a nitriding treatment, and further applying shot peening.

3. A steel surface hardening treatment apparatus comprising a carburizing zone, a cooling zone for implementing diffusion transformation and a nitriding treatment compartment for implementing the formation of a nitride layer connected through opening and shutting doors are installed , and each of said zones being provided with feeding devices enabling the feeding of steel parts to the next zone.

4. The steel surface hardening treatment apparatus described in claim 3 wherein a heat exchanger is provided in the cooling zone.

* * * * *